US010636597B2

(12) United States Patent
Tadele et al.

(10) Patent No.: US 10,636,597 B2
(45) Date of Patent: Apr. 28, 2020

(54) THERMAL FUSE

(71) Applicant: BorgWarner Ludwigsburg GmbH, Ludwigsburg (DE)

(72) Inventors: Sisay Tadele, Friolzheim (DE); Alexander Dauth, Maulbronn (DE); Steffen Geiger, Asperg (DE); Markus Wetzel, Filderstadt (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 16/509,008

(22) Filed: Jul. 11, 2019

(65) Prior Publication Data

US 2020/0027682 A1 Jan. 23, 2020

(30) Foreign Application Priority Data

Jul. 17, 2018 (DE) ..... 10 2018 117 243
Jul. 27, 2018 (DE) ..... 10 2018 118 247

(51) Int. Cl.
*H01H 37/76* (2006.01)
*H01H 85/36* (2006.01)

(52) U.S. Cl.
CPC ..... *H01H 37/761* (2013.01); *H01H 37/76* (2013.01); *H01H 85/36* (2013.01); *H01H 2037/763* (2013.01)

(58) Field of Classification Search
CPC ..... H01H 37/76; H01H 37/761; H01H 2037/763; H01H 85/36
See application file for complete search history.

(56) References Cited

U.S. PATENT DOCUMENTS 2,718,569 A * 9/1955 Johnston ..... H01H 71/142 335/208
3,639,867 A 2/1972 Tanimura et al.
4,514,716 A * 4/1985 Vincent De Araujo ..... H01H 85/38 337/281
4,599,597 A 7/1986 Rotbart
9,620,321 B2 4/2017 Störzinger et al.
2002/0153991 A1* 10/2002 Haeusel ..... H01H 37/761 337/404
2006/0250209 A1* 11/2006 Yu ..... H01H 37/002 337/36
2008/0117016 A1* 5/2008 Yu ..... H01H 37/761 337/401
2018/0040443 A1* 2/2018 Yokota ..... H01H 85/46

FOREIGN PATENT DOCUMENTS

DE 2 012 448 A1 10/1970
DE 10 2014 111 772 A1 2/2016

* cited by examiner

*Primary Examiner* — Jacob R Crum
(74) *Attorney, Agent, or Firm* — Bose McKinney & Evans LLP

(57) ABSTRACT

A thermal fuse for an electrical circuit is described, with a contact arm by way of which two electrical conductors are electrically conductively connected to each other, wherein the connection of the contact arm to at least one of the two conductors is a soldered joint, which loses its strength when a activation temperature of the fuse is reached. In accordance with this disclosure a permanent magnet is provided, which generates a magnetic force, which lifts the contact arm from at least one of the two conductors as soon as the soldered joint loses its strength.

8 Claims, 1 Drawing Sheet

THERMAL FUSE

RELATED APPLICATIONS

This application claims priority to DE 10 2018 117 243.5, filed Jul. 17, 2018, and claims priority to DE 10 2018 118 247.3, filed Jul. 27, 2018, the entire disclosures of which are hereby incorporated herein by reference.

BACKGROUND

This disclosure refers to a thermal fuse for an electrical circuit generally of the type known from DE 10 2014 111 772 B4, for example.

In the fuse disclosed in DE 10 2014 111 772 B4, two conductors are electrically connected to each other by means of a mechanically preloaded contact arm. The contact arm is welded to one of the two electrical conductors, and soldered to the other. When the fuse activation temperature is reached, the soldered joint loses its strength, such that the preloaded contact arm lifts from the conductor in question and the circuit is thus interrupted. Instead of a welded joint, the contact arm may also be connected to one of the two conductors by means of another soldered joint, which only loses its strength at a higher temperature, such that when the activation temperature of the fuse is reached the same end of the contact arm always lifts from one of the two conductors.

This known fuse is well suited for circuits with low electrical voltages of up to 12 volts, such as those used in passenger vehicles. However, the opening gap that can be achieved is relatively small, and is insufficient for applications with higher voltages, e.g., 48 volts. At higher voltages there is therefore a risk that an electrical arc will form between a conductor and the lifted contact arm as the fuse is opened. This arc is a hazard that can lead to a fire.

SUMMARY

This disclosure demonstrates a way of increasing the opening gap in a thermal fuse of the type mentioned above.

A fuse in accordance with this disclosure comprises a permanent magnet, which generates a magnetic force that lifts the contact arm from at least one of the two conductors as soon as the soldered joint between the contact arm and at least one of the two conductors loses its strength. The contact arm can be soldered to both conductors, such that when the activation temperature is reached, the contact arm detaches from both conductors under the influence of the magnetic force, and is lifted from them. The contact arm is then held by the permanent magnet, such that the contact arm cannot cause inadvertent contacts or short circuits. It is also possible that when the activation temperature is reached, the contact arm will only detach from one of the two conductors, and will remain connected to the other conductor, for example, by being welded to the latter. When the activation temperature is reached, the magnetic force then causes the contact arm to lift from only one of the two conductors.

Permanent magnets can be arranged compactly in or on a housing of the fuse, such that their magnetic force produces an appropriately large opening gap as soon as the contact arm lifts from at least one of the two conductors when the activation temperature of the fuse is reached.

The direction in which the contact arm moves when the fuse is activated can be determined by the permanent magnet. In addition, the contact arm can be fixed in its activated position by means of the permanent magnet, in particular by the fact that in its activated position the contact arm abuts against the permanent magnet.

The contact arm may be made of iron or ferromagnetic steel. However, it is also possible to use a non-magnetic metal, e.g., copper or aluminium, and to attach a permanent magnet or magnetic material to the contact arm, which then interacts with a permanent magnet arranged at a distance from the contact arm. Ferrite magnets, AlNiCo magnets or rare earth magnets, in particular neodymium-iron-boron magnets, can be used as permanent magnets in a fuse in accordance with this disclosure. In this context, the only point to note is that the Curie temperature of the permanent magnet(s) must be sufficiently high, such that they still generate a sufficiently strong magnetic force when the activation temperature of the fuse is reached.

The activation temperature of the fuse can be adjusted by the choice of the solder material. A solder material with a relatively low melting point is, e.g., Sn42Bi58 with a $T_{liq}$=140° C.; a solder material with a higher melting point is, e.g., Sn96.5Ag3Cu0.5 with a $T_{liq}$=221° C.

The fuse can advantageously be arranged on the current input station of a plug. The advantage of this is that the functional interruption of a device can take place at a very early stage. More severe damage can thereby be avoided.

It is particularly advantageous if the safety device is arranged such that in operation the magnetic force acts in the direction of gravity. A falling contact arm thereby moves reliably towards the permanent magnet and can then be held by the latter.

In another advantageous refinement of this disclosure provision is made for the contact arm to be mechanically preloaded, such that at least one soldered joint is mechanically loaded by a spring force. The contact arm can, for example, be a leaf spring, in particular a bent strip of spring plate. In this way the force with which the contact arm lifts from one or both conductors when the activation temperature is reached can be increased.

In another advantageous refinement of this disclosure provision is made for the contact arm or one of the conductors soldered to the contact arm to be a preloaded leaf spring, the spring force of which is applied to the soldered joint. When the fuse is activated, the conductor can thus also move away from the contact arm, increasing the opening gap even further.

In another advantageous refinement of this disclosure provision is made for the conductor, or one of the conductors, soldered to the contact arm to be a "thermal material", whose mechanical spring properties increase with increasing temperature. Such thermal materials are, e.g., thermobimetals or shape memory alloys. The use of a preloaded leaf spring made of a thermal material has the advantage that the force on the soldered joint is lower in normal operation.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

The embodiments described below are not intended to be exhaustive or to limit the invention to the precise forms disclosed in the following description. Rather, the embodiments are chosen and described so that others skilled in the art may appreciate and understand the principles and practices of this disclosure.

Figure 1:
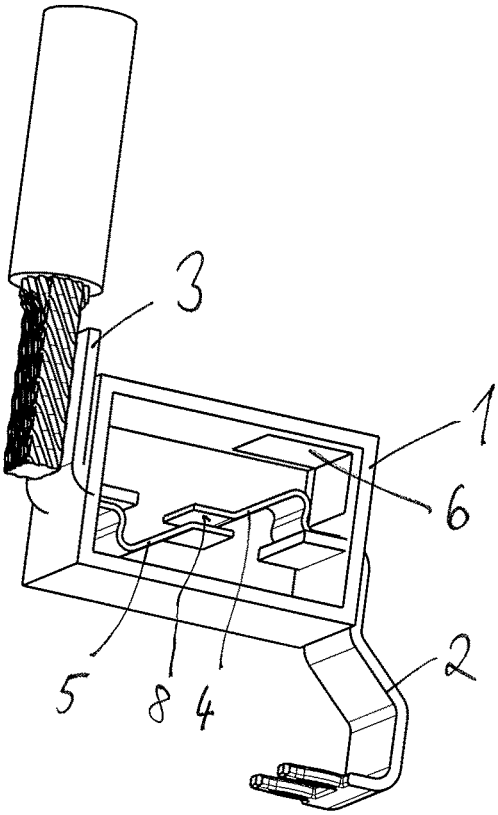
FIG. 1 shows an example of embodiment of a thermal fuse.
Figure 2:
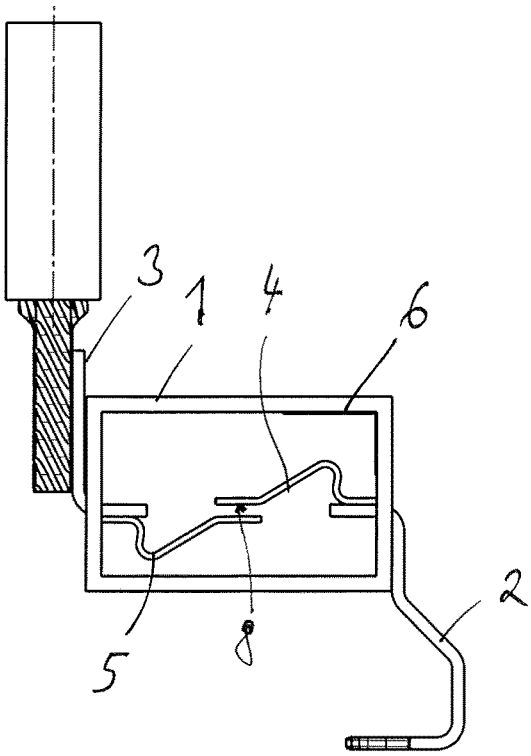
FIG. 2 shows another view relative to FIG. 1.

FIGS. 1 and 2 schematically illustrate a thermal fuse in an open state. The fuse comprises a contact arm 4, which, when the fuse is closed, electrically connects two electrical conductors, e.g., a conductor 2 and a leaf spring 5. When the fuse is closed, the contact arm 4 is soldered to one of these two conductors by way of a soldered joint 8.

A magnetic force of a permanent magnet 6 of the fuse acts on the contact arm 4. When the fuse reaches its activation temperature, the soldered joint loses its strength. Under the action of the magnetic force the contact arm 4 is then lifted from the conductor that was soldered to it, e.g., the leaf spring 5, so that the fuse opens. For this purpose the contact arm 4 can be made of iron or ferromagnetic steel, for example. However, it is also possible to manufacture the contact arm from a non-ferromagnetic material, and to attach a second permanent magnet or a ferromagnetic part, such as a rivet, to the contact arm.

To aid the opening movement, the contact arm 4 can be mechanically preloaded, such that a spring force is also applied to the soldered joint in addition to the magnetic force. When the activation temperature is reached, the fuse can thus open even faster and an even greater opening gap can be achieved. Since the conductor soldered to the contact arm 4 is a leaf spring 5, the opening speed and the opening gap can be further increased by preloading the leaf spring 5.

The fuse shown has a housing 1 from which two conductors 2, 3 protrude. The conductors 2, 3 are electrical conductors, which, at their ends protruding from the housing 1, can have plug-in contacts, for example for insertion into the holes of a printed circuit board, or can be fitted with a stranded cable for purposes of soldering or welding. The conductor 2 is connected, for example welded, to the contact arm 4. The connecting conductor 3 can be soldered directly to the contact arm 4, but in the example shown it is electrically connected to the contact arm 4 via the leaf spring 5. The leaf spring 5 can, for example, be welded to the connecting conductor 3.

In the example embodiment illustrated in the figures, the contact arm 4 is soldered at one end to a conductor, e.g., a leaf spring 5, by way of the soldered joint 8, and is welded at its other end to a conductor, e.g., the connecting conductor 2. However, it is also possible to solder the contact arm 4 at both ends, i.e., both with the leaf spring 5 and also with the connecting conductor 2, or with both connecting conductors 2, 3. If the soldered joint then loses its strength, the entire contact arm 4 can be lifted from both conductors that were soldered to it by the magnetic force of the permanent magnet 6. In this way, a particularly large opening gap can be achieved. Also with this embodiment, the opening movement can be aided by preloading the contact arm 4 and/or a conductor soldered to it, e.g., a leaf spring 5.

In the example of embodiment illustrated, the contact arm 4 and the leaf spring 5 have the same shape, but are preferably made from different materials. Ferromagnetic materials such as iron or a ferromagnetic steel are advantageous for the contact arm 4, while non-magnetic materials such as aluminium or brass are more suitable for the leaf spring 5. In this way it is possible to prevent the leaf spring 5 from being attracted to the contact arm 4 by magnetic force.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE LIST

1 Housing
2 Connecting conductor
3 Connecting conductor
4 Contact arm
Leaf spring
7 Permanent magnet
8 Soldered joint

What is claimed is:

1. A thermal fuse for an electrical circuit, comprising:

a contact arm that electrically and conductively connects two electrical conductors;

a soldered joint connecting the contact arm to one of the two electrical conductors, wherein the soldered joint loses its strength when an activation temperature of the fuse is reached; and a permanent magnet configured to generate a magnetic force which lifts the contact arm as soon as the soldered joint between the contact arm and the one of the two conductors loses its strength.

2. The thermal fuse in accordance with claim 1, further comprising a second soldered joint connecting the contact arm to the other of the two electrical conductors.

3. The thermal fuse in accordance with claim 1, wherein the contact arm is made of iron or ferromagnetic steel.

4. The thermal fuse in accordance with claim 1, wherein the contact arm is mechanically preloaded, wherein a spring force is applied to the soldered joint.

5. The thermal fuse in accordance with claim 1, wherein the contact arm is a leaf spring.

6. The thermal fuse in accordance with claim 5, wherein the conductor soldered to the contact arm is a preloaded leaf spring whose spring force is applied to the soldered joint.

7. The thermal fuse in accordance with claim 6, wherein the two leaf springs are of the same shape.

8. The thermal fuse in accordance with claim 1, wherein the contact arm is arranged in a housing to which the permanent magnet is attached.

* * * * *